US008997766B2

(12) United States Patent
Pao

(10) Patent No.: US 8,997,766 B2
(45) Date of Patent: Apr. 7, 2015

(54) WALKING STICK CHAIR

(71) Applicant: Chih-Ting Pao, Taichung (TW)

(72) Inventor: Chih-Ting Pao, Taichung (TW)

( * ) Notice: Subject to any disclaimer, the term of this patent is extended or adjusted under 35 U.S.C. 154(b) by 0 days.

(21) Appl. No.: 13/831,574

(22) Filed: Mar. 14, 2013

(65) Prior Publication Data

US 2014/0060598 A1 Mar. 6, 2014

(30) Foreign Application Priority Data

Aug. 29, 2012 (TW) ..... 101131365 A
Dec. 28, 2012 (TW) ..... 101151168 A

(51) Int. Cl.
*A45B 5/00* (2006.01)
*A47C 4/04* (2006.01)

(52) U.S. Cl.
CPC .... *A45B 5/00* (2013.01); *A47C 4/04* (2013.01)

(58) Field of Classification Search
CPC ..... A45B 5/00; A45B 25/16
USPC ..... 135/66; 297/118, 16.2, 16.1, 183.5
See application file for complete search history.

(56) References Cited

U.S. PATENT DOCUMENTS 2,380,437 A * 7/1945 Homrighausen ..... 297/55
2,629,429 A * 2/1953 Baumfeld et al. ..... 297/58
2,766,813 A * 10/1956 Kay ..... 297/54
2,991,035 A * 7/1961 Puckett ..... 248/155
3,073,327 A * 1/1963 Foltis et al. ..... 135/22
3,537,748 A * 11/1970 Knapp ..... 297/118
3,999,565 A 12/1976 Delacour et al.
6,908,154 B2 6/2005 Aono
7,614,414 B2 11/2009 Jamshidi

FOREIGN PATENT DOCUMENTS

| | | | |
|---|---|---|---|
| CN | 2123908 | U | 12/1992 |
| CN | 2471165 | Y | 1/2002 |
| CN | 201271345 | Y | 7/2009 |
| CN | 202085868 | U | 12/2011 |
| JP | 2004-121771 | A | 4/2004 |
| TW | 143769 | A4 | 10/1990 |
| TW | 277239 | | 3/2007 |

OTHER PUBLICATIONS

Search Report of PCT Application No. PCT/CN2012/081462 issued by the State Intellectual Property Office of the P.R.C. on Jun. 20, 2013 (12 pages).

* cited by examiner

*Primary Examiner* — Noah Chandler Hawk
(74) *Attorney, Agent, or Firm* — DLA Piper LLP (US)

(57) ABSTRACT

A walking stick chair includes a main stick, a seat unit, a support unit, and a linking unit. The seat unit includes a sleeve member connected in a fixed position to the main stick, and a seat member connected pivotally to the sleeve member and operable between a folded state and an unfolded state. The support unit is connected pivotally to the main stick. The linking unit is connected pivotally to the support unit and the seat member. When the seat member is at the unfolded state, the walking stick chair serves as a chair, and when the seat member is operated from the unfolded state to the folded state, the walking stick chair is converted from the chair to a walking stick.

11 Claims, 14 Drawing Sheets

WALKING STICK CHAIR

CROSS-REFERENCE TO RELATED APPLICATIONS

This application claims priority of Taiwanese Application No. 101131365, filed on Aug. 29, 2012, and Taiwanese Application No. 101151168, filed on Dec. 28, 2012.

BACKGROUND OF THE INVENTION

1. Field of the Invention

The invention relates to a walking stick, more particularly to a foldable walking stick chair that is convertible between a walking stick and a chair.

2. Description of the Related Art

Elder people have inferior physical condition. Usually, they need to walk with a walking stick, and take a rest after walking for a period of time. Taiwanese Utility Model Patent No. 277239 discloses a conventional foldable walking stick chair including a main stick, a leg unit and a seat unit. The main stick has a handle portion and a foot portion opposite to the handle portion. The leg unit is connected pivotally to the main stick at a pivot point to form a scissors-like structure, and has a support end and a connecting end opposite to the support end. The seat unit includes a slider member connected slidably to the main stick between the handle portion and the pivot point, and a seat plate connected pivotally to the slider member and the connecting end of the leg unit to form a slider-crank mechanism.

When the conventional walking stick chair is unfolded to be utilized as a chair, the main stick and the leg unit form an angle, the support end of the leg unit cooperates with the foot portion of the main stick for supporting the entire walking stick chair, and the seat plate is horizontal and forms an angle with the main stick. When the conventional walking stick chair is folded to be utilized as a walking stick, the slider member is moved upwardly toward the handle portion, the seat plate pivots downwardly relative to the slider member to be close to the main stick, and the leg unit pivots toward the main stick to reduce the angle between the leg unit and the main stick. At the folded state, the support end of the leg unit is lifted from the ground.

Despite being operable between a folded state and an unfolded state, the abovementioned walking stick chair has several disadvantages:

1. When the walking stick chair serves as a walking stick at the folded state, the support end of the leg unit is still proximate to the ground. If the ground is uneven, the support end may hit a projecting portion of the ground. Moreover, since the leg unit is X-shaped, a user may easily stumble on the leg unit when using the conventional walking stick chair as a walking stick.

2. In the folded state, the center of gravity of the walking stick chair is distal from the handle portion, so that the walking stick chair is laborious for the user when being used as a walking stick.

U.S. Pat. No. 3,999,565, U.S. Pat. No. 2,380,437, and U.S. Pat. No. 7,614,414 have disadvantages similar to the abovementioned walking stick chair.

SUMMARY OF THE INVENTION

Therefore, the object of the present invention is to provide a walking stick chair that is labor-saving and safe when serving as a walking stick.

Accordingly, a walking stick chair of the present invention comprises:

a main stick having an elongated rod body that has opposite upper and lower ends, a handle portion that is connected to the upper end of the rod body, and a foot portion that is connected to the lower end of the rod body;

a seat unit including a sleeve member that is connected in a fixed position to the rod body, and a seat member that is connected pivotally to the sleeve member and that is operable between a folded state where the seat member extends upwardly from the sleeve member and is close to the rod body, and an unfolded state where the seat member and the rod body form an angle;

a support unit having a pivoted end portion that is connected pivotally to the rod body under the sleeve member of the seat unit, and a free end portion that is opposite to the pivoted end portion; and a linking unit having a driven portion connected pivotally to the seat member and a driving portion connected pivotally to the support unit;

wherein, when the seat member is at the unfolded state, the support unit is at an unfolded state where the free end portion of the support unit is away from the rod body and cooperates with the foot portion for contacting ground; and wherein, when the seat member is operated to pivot upwardly from the unfolded state to the folded state, the linking unit is driven to move upwardly to actuate the support unit to pivot upwardly to a folded state where the free end portion is close to the rod body.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
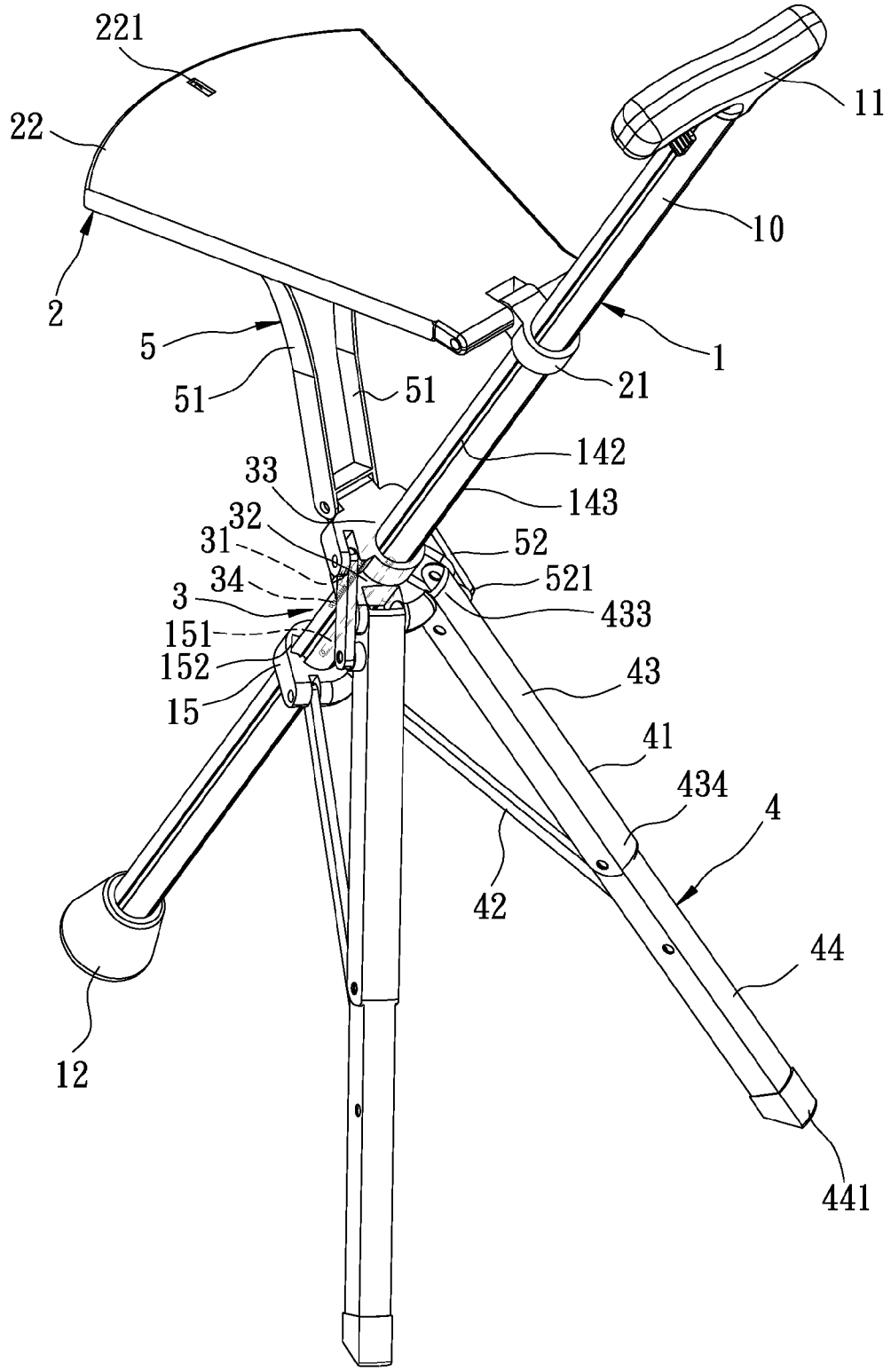
FIG. 1 is a perspective view of a first preferred embodiment of a walking stick chair according to the invention at an unfolded state.
Figure 2:
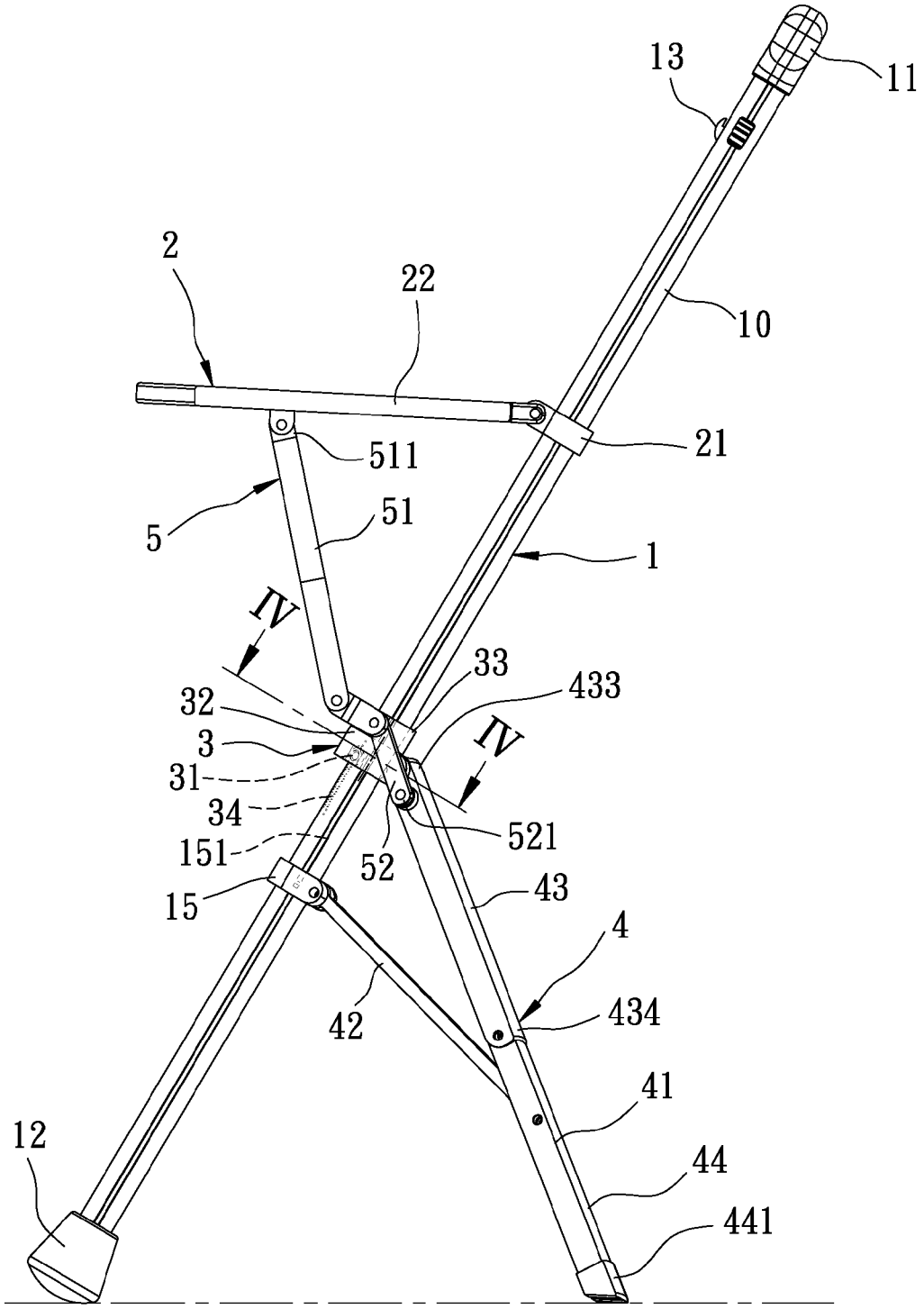
FIG. 2 is a side view of the first preferred embodiment at the unfolded state.

As shown in FIGS. 1 and 2, a first preferred embodiment of a walking stick chair according to the present invention comprises a main stick 1, a seat unit 2, a positioning unit 3, a support unit 4, and a linking unit 5.

The main stick 1 has an elongated rod body 10 that has opposite upper and lower ends, a hook-shaped handle portion 11 that is connected to the upper end of the rod body 10, a foot portion 12 that is connected to the lower end of the rod body 10, a resilient hook member 13 that is disposed near the handle portion 11, and a plurality of angularly spaced-apart grooves 141, 142, 143, 144 (see FIG. 4) that are formed in an outer surface of the rod body 10 and that extend in a longitudinal direction of the rod body 10.

Figure 4:
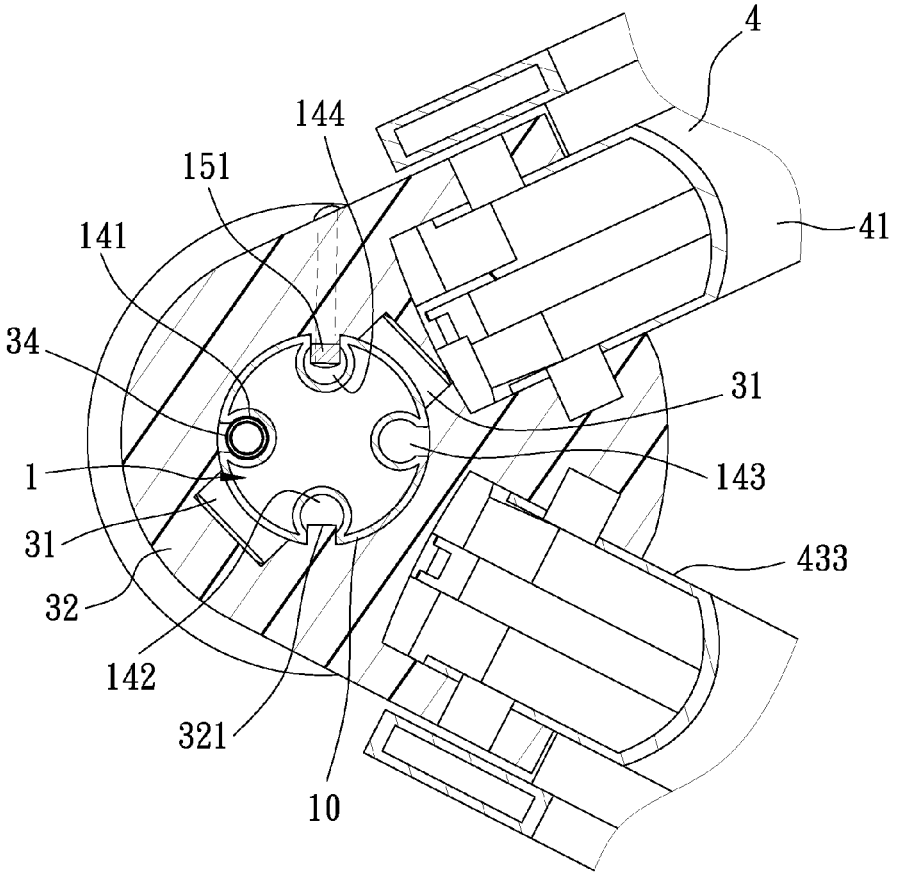
FIG. 4 is a fragmentary sectional view of the first preferred embodiment taken along line IV-IV in FIG. 2.

As shown in FIG. 4, the rod body 10 is tubular and formed by a rod body wall with a thickness shorter than depths of the grooves 141, 142, 143, 144, and the configuration of the grooves 141, 142, 143, 144 enhances the structural strength of the rod body 10.

Figure 5:
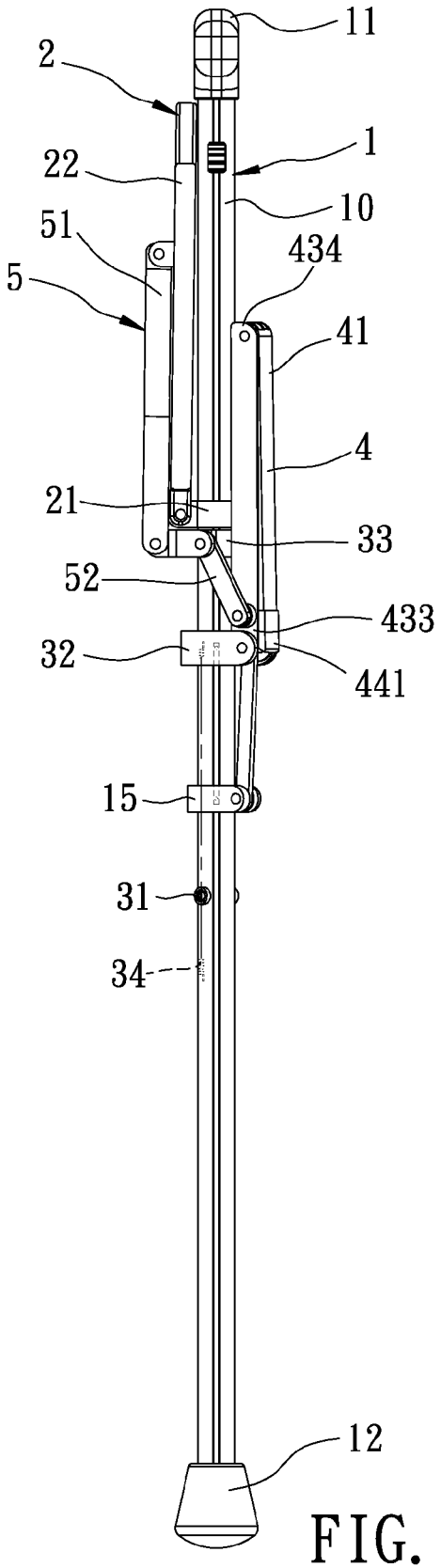
FIG. 5 is another side view of the first preferred embodiment at a folded state.

The seat unit 2 includes a sleeve member 21 that is connected in a fixed position to the rod body 10, and a seat member 22 that is connected pivotally to the sleeve member 21. The seat member 22 is operable between a folded state where the seat member 22 extends upwardly from the sleeve member 21 and is close to the rod body 10 (see FIG. 5), and an unfolded state where the seat member 22 and the rod body 10 form an angle (see FIG. 2). The seat member 22 has an engaging groove 221 that is engageable with the resilient hook member 13.

The positioning unit 3 includes an abutment member 31 connected immovably to the rod body 10 under the sleeve member 21, upper and lower slider members 33, 32 connected slidably to the rod body 10 and disposed between the abutment member 31 and the sleeve member 21, and a resilient member 34 connected between the lower slider member 32 and the rod body 10 for biasing the lower slider member 32 toward the abutment member 31. The abutment member 31 is configured as a pair of blocks protruding from the outer surface of the rod body 10. The upper slider member 33 is disposed above the lower slider member 32. The lower slider member 32 has a guide block 321 engaging slidably the groove 142 for preventing rotation of the lower slider member 32 relative to the rod body 10 (see FIG. 4). The resilient member 34 is disposed in the groove 141. The main stick 1 further has a bottom slider member 15 connected slidably to the rod body 10 and disposed between the lower slider member 32 and the foot portion 12, and a connecting rod 151 disposed in the groove 144 and interconnecting co-movably the lower and bottom slider members 32, 15. The bottom slider member 15 has a pair of passage grooves 152 adjacent to the outer surface of the rod body 10 and corresponding in angular position to the blocks of the abutment member 31.

The support unit 4 includes a pair of support legs 41, each of which has an upper leg component 43 and a lower leg component 44. The upper leg component 43 has a pivoted end portion 433 connected pivotally to the lower slider member 32, and an opposite end portion 434 opposite to the pivoted end portion 433. The lower leg component 44 has a free end portion 441, and an opposite end portion opposite to the free end portion 441 and connected pivotally to the opposite end portion 434 of the upper leg component 43. The support unit 4 further includes a pair of auxiliary linkages 42, each of which has an end connected pivotally to the bottom slider member 15 and an opposite end connected pivotally to a respective one of the lower leg components 44.

The linking unit 5 includes a pair of first linking members 51, each having one end serving as a driven portion 511 connected pivotally to the seat member 22 and an opposite end connected pivotally to the upper slider member 33, and a pair of second linking members 52, each having one end serving as a driving portion 521 connected pivotally to a respective one of the upper leg components 43 of the support unit 4 and an opposite end connected pivotally to the upper slider member 33. Each first linking member 51 has a length larger than a distance between the driven portion 511 and the sleeve member 21. Each second linking member 52 has a length larger than a distance between the driving portion 521 and the pivoted end portion 433 of the corresponding upper leg component 43.

When the seat member 22 is at the unfolded state, referring to FIGS. 1 and 2, the support legs 41 are unfolded where the free end portions 441 of the lower leg components 44 are away from the rod body 10 and cooperate with the foot portion 12 of the main stick 1 for contacting ground, the lower slider member 32 abuts against the abutment member 31, and the upper slider member 33 abuts against the lower slider member 32. As such, the walking stick chair of this embodiment can serve as a chair.

Figure 3:
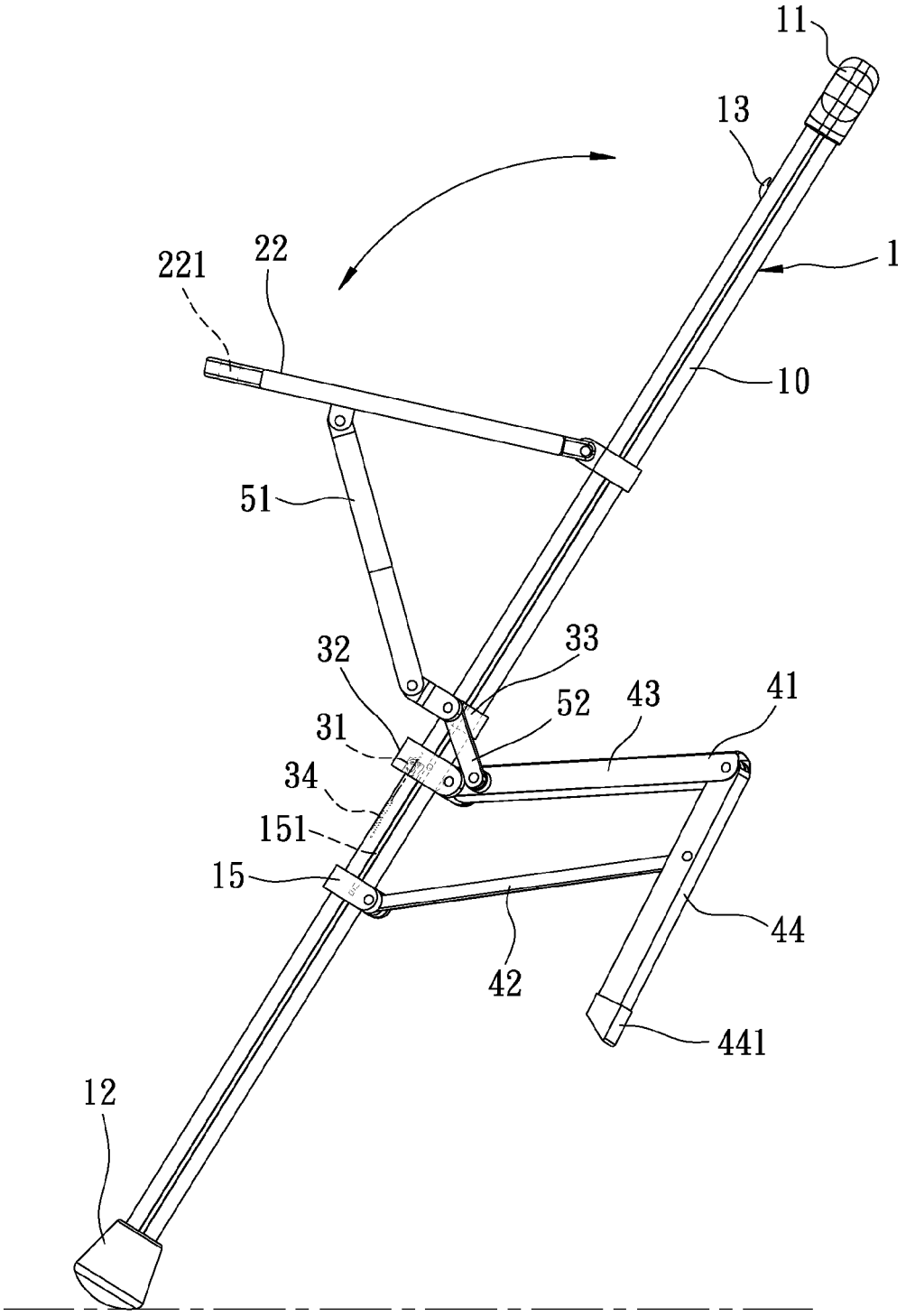
FIG. 3 is another side view of the first preferred embodiment beginning to be folded.
Figure 6:
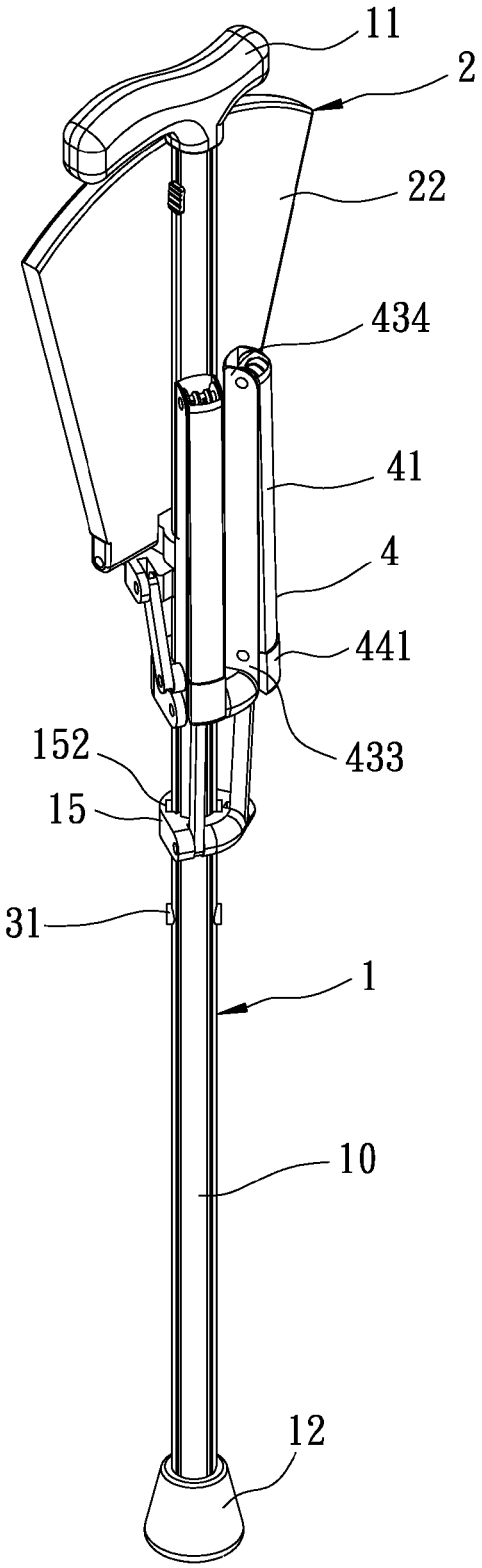
FIG. 6 is another perspective view of the first preferred embodiment at the folded state.

To collapse the walking stick chair, as shown in FIG. 3, the seat member 22 is operated to pivot upwardly from the unfolded state to the folded state, thereby driving the first linking members 51, the upper slider member 33 and the second linking members 52 to move upwardly. Since the resilient member 34 biases the lower slider member 32 toward the abutment member 31 and the connecting rod 151 interconnects co-movably the lower and bottom slider members 32, 15, the upward movements of the second linking members 52 first actuate the upper leg components 43 to pivot upwardly without moving the lower slider member 32, the connecting rod 151, and the bottom slider member 15. Simultaneously, the auxiliary linkages 42 actuate the lower leg components 44 to pivot downwardly. After the support legs 41 are driven to a folded state where the free end portions 441 are close to the rod body 10, with further upward pivotal movement of the seat member 22, the lower slider member 32, the connecting rod 151, and the bottom slider member 15 are driven to move upwardly until the seat member 22 pivots to the folded state. As a result, the center of gravity of the walking stick chair is moved toward the handle portion 11. When the seat member 22 pivots from the unfolded state to the folded state, the passage grooves 152 move respectively past the blocks of the abutment member 31 to permit the bottom slider member 15 to slide over the abutment member 31 (see FIGS. 5 and 6). The engaging groove 221 is engaged releasably with the resilient hook 13 when the seat member 22 is at the folded state.

To sum up, when the first preferred embodiment is at the folded state to serve as a walking stick, since the center of gravity thereof is raised close to the handle portion 11, walking with such a walking stick is labor-saving for a user. On the other hand, when being folded, the support legs 41 pivot upwardly with the free end portions 441 being close to the rod body 10 and away from the foot portion 12, so that the free end portions 441 would not hit the projecting portion of the ground, and the user would not stumble on the support legs 41.

Figure 7:
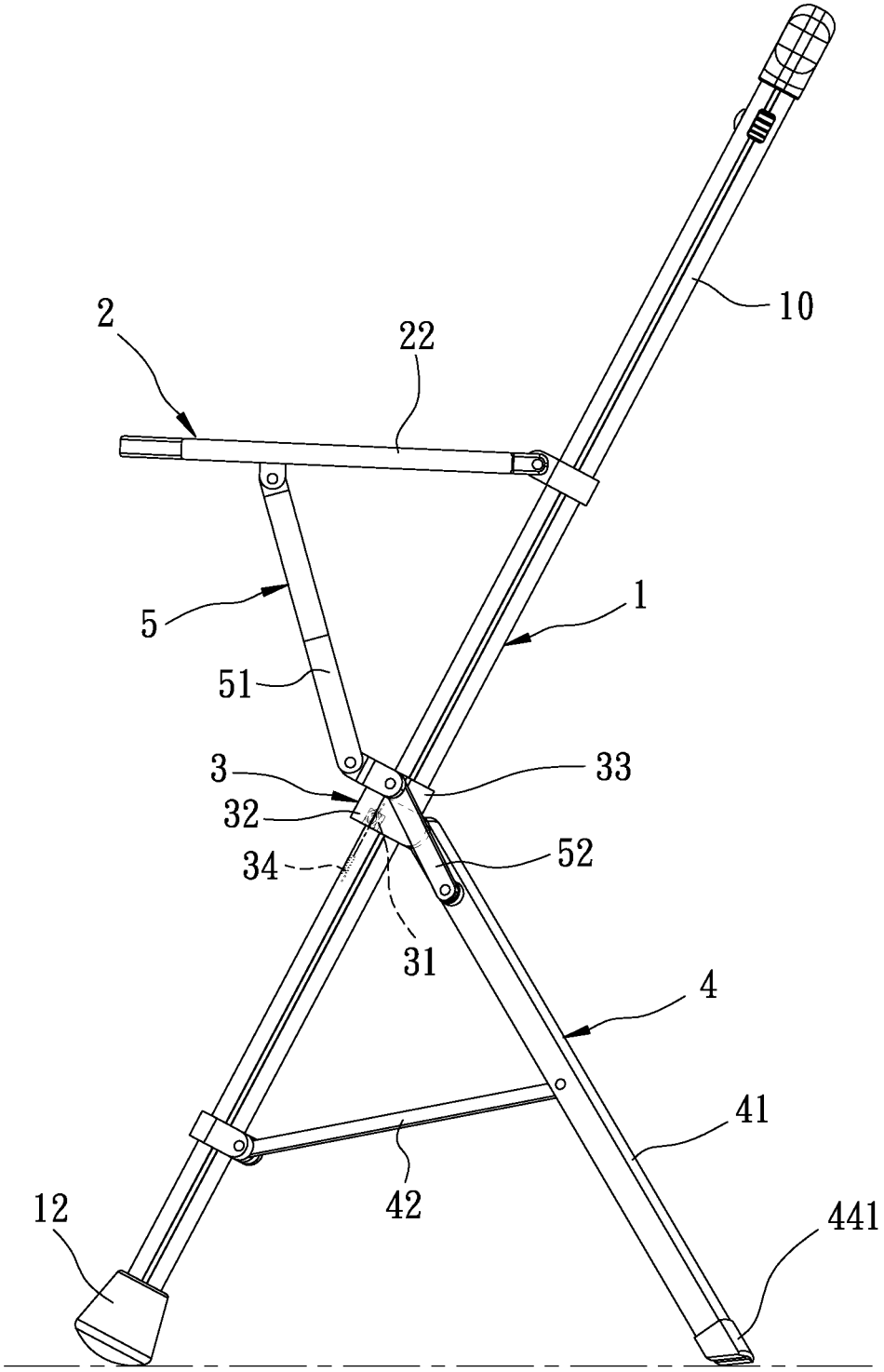
FIG. 7 is a side view of a second preferred embodiment according to the invention at the unfolded state.

FIG. 7 illustrates a second preferred embodiment of this invention, in which the connecting rod 151 is omitted, and each of the support legs 41 of the support unit 4 is configured as a single bar. When the seat member 22 is at the unfolded state, the free end portions 441 of the support legs 41 cooperate with the foot portion 12 of the main stick 1 for contacting ground. It should be noted that only one first linking member 51, one second linking member 52, one support leg 41 and one auxiliary linkage 42 is visible in FIG. 7.

Figure 8:
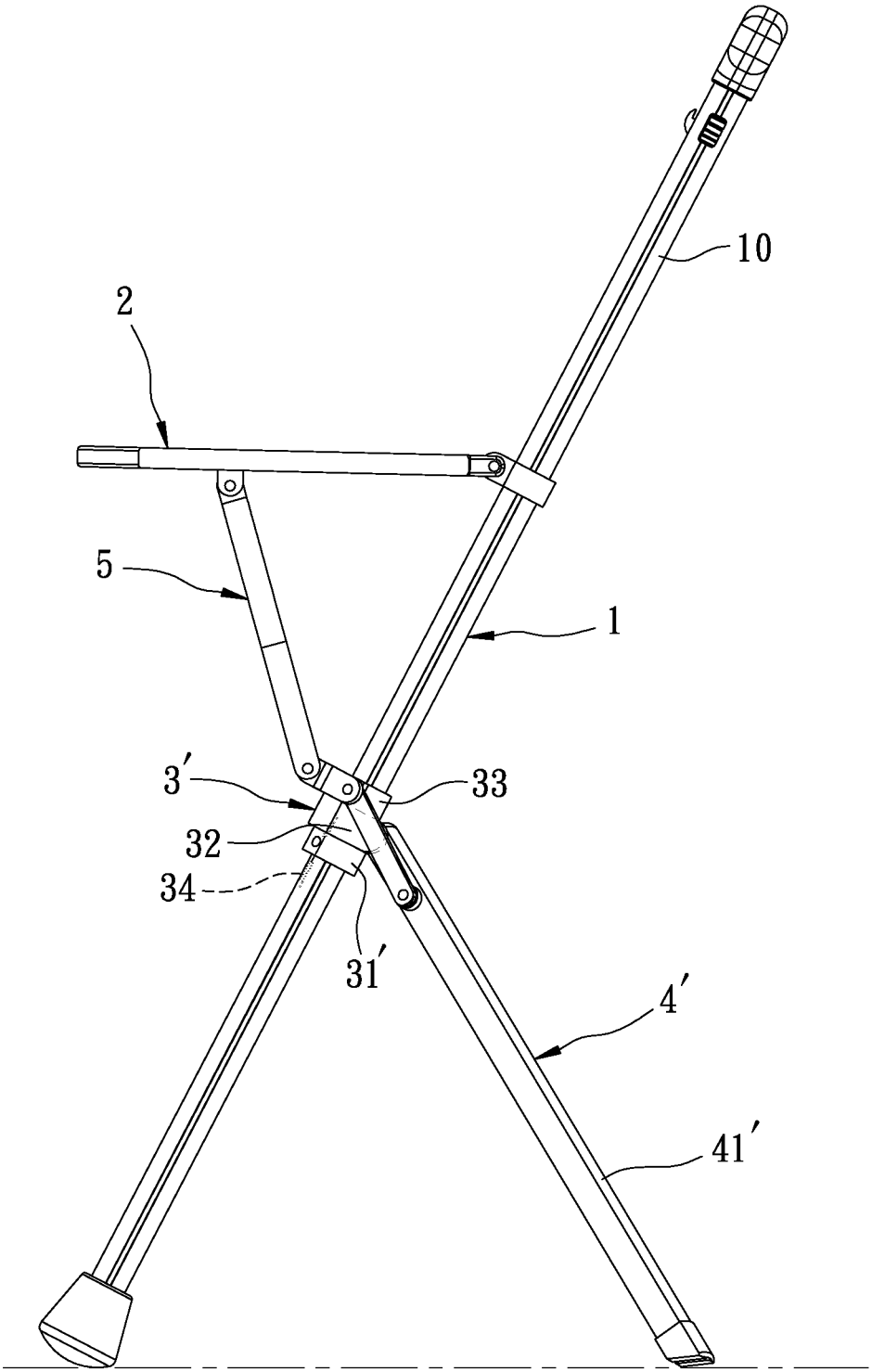
FIG. 8 is a side view of a third preferred embodiment according to the invention at the unfolded state.

Referring to FIG. 8, a third preferred embodiment of this invention omits the connecting rod 151, the bottom slider member 15 and the auxiliary linkages 42 in the first preferred embodiment. Each of the support legs 41' of the support unit 4' is configured as a single bar, and the abutment member 31' of the positioning unit 3' is ring-shaped and surrounds immovably the rod body 10.

Figure 9:
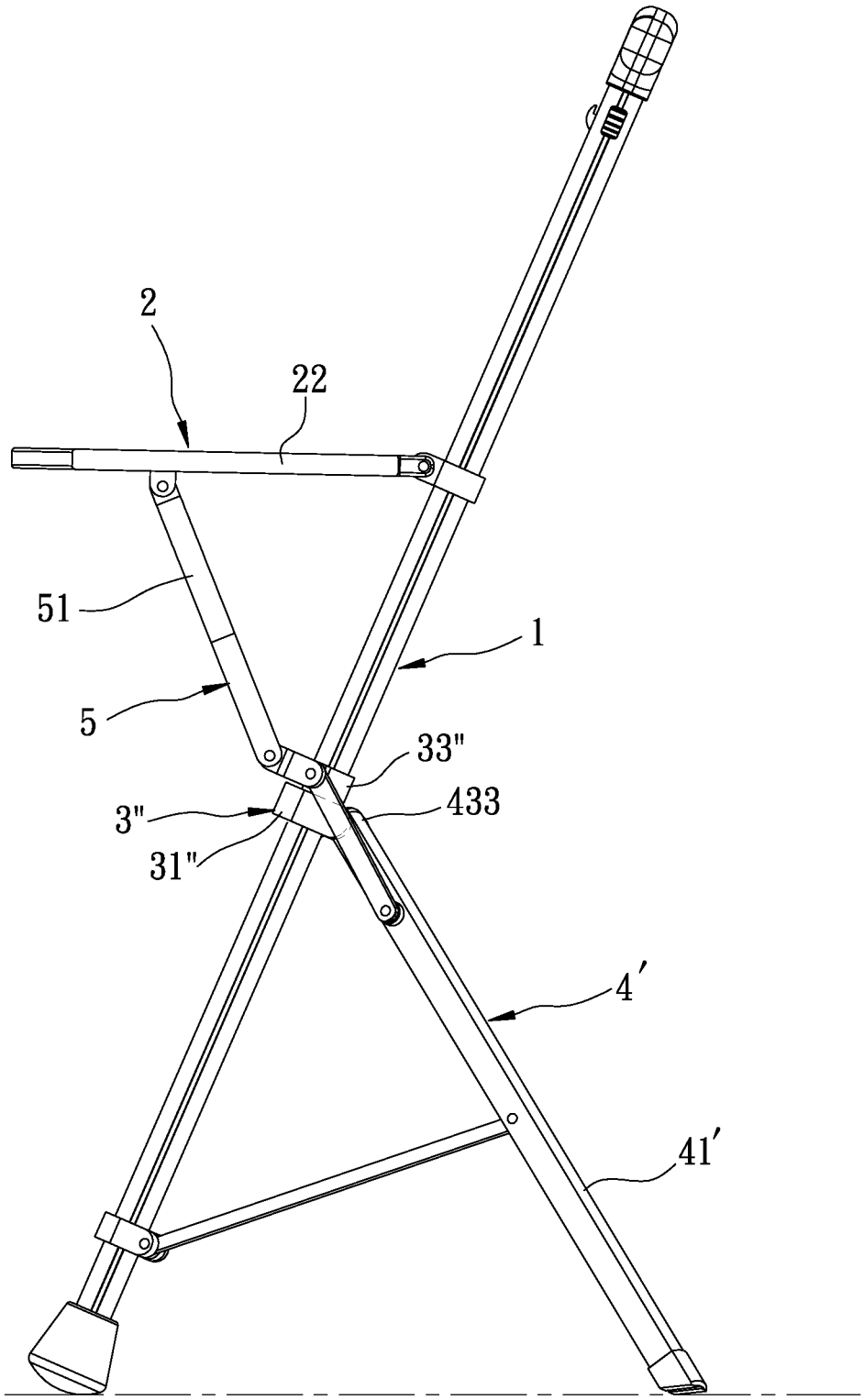
FIG. 9 is a side view of a fourth preferred embodiment according to the invention at the unfolded state.

FIG. 9 illustrates a fourth preferred embodiment of this invention, in which the positioning unit 3" merely includes the abutment member 31" and a middle slider member 33". Each of the support legs 41' of the support unit 4' is configured as a single bar, and has the pivoted end portion 433 connected pivotally to the abutment member 31". The connecting rod 151 in the first preferred embodiment is also omitted, and the first linking members 51 are connected between the seat member 22 of the seat unit 2 and the middle slider member 33".

Figure 10:
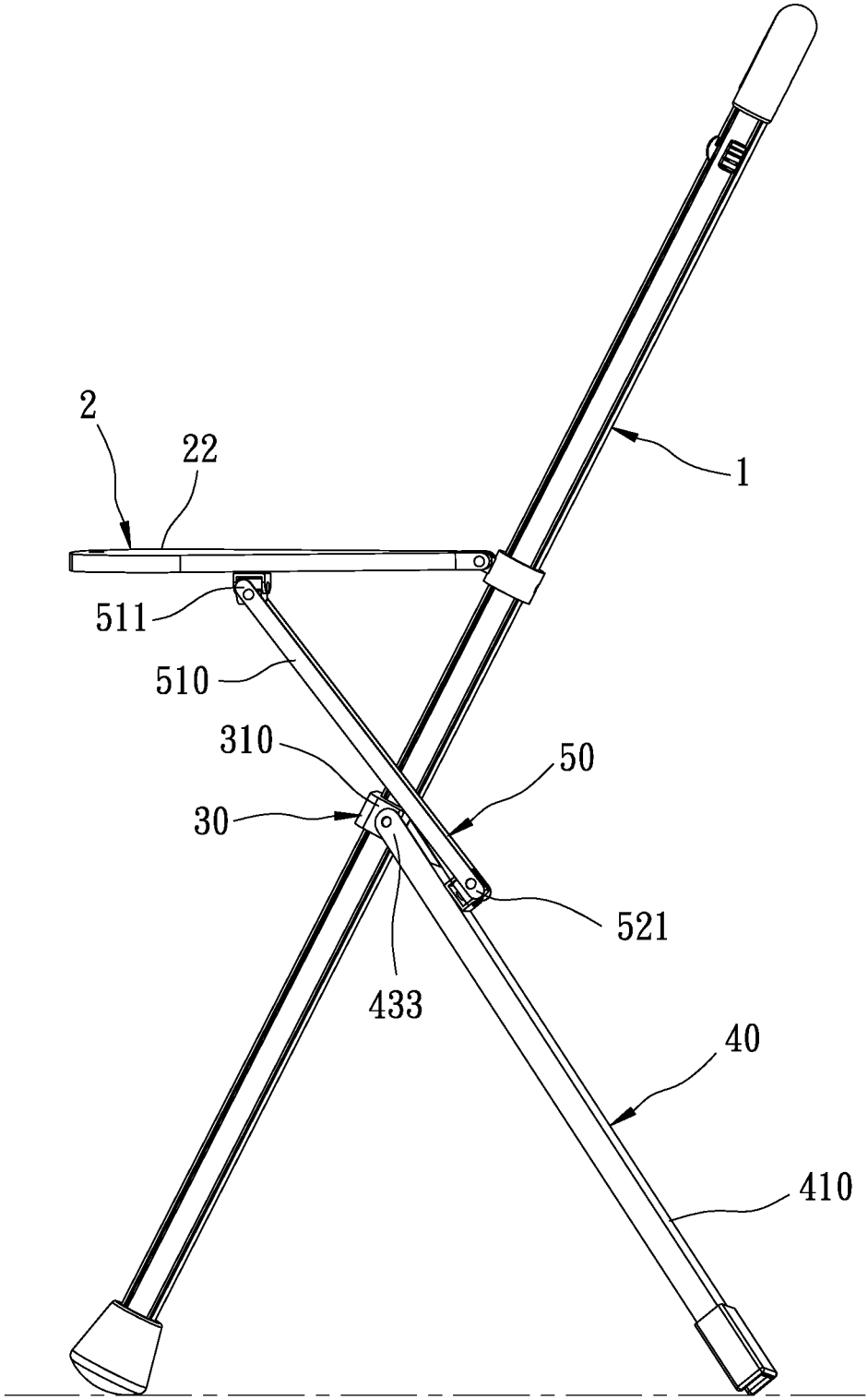
FIG. 10 is a side view of a fifth preferred embodiment according to the invention at the unfolded state.

FIG. 10 illustrates a fifth preferred embodiment of this invention. Each of the support legs 410 of the support unit 40 is configured as a single bar, and the connecting rod 151, the bottom slider member 15 and the auxiliary linkages 42 in the first preferred embodiment are omitted. The positioning unit 30 has only the abutment member 310. The linking unit 50 includes a pair of the linking members 510, each of which has the driven and driving portions 511, 521 provided at opposite ends thereof and connected pivotally and respectively to the seat member 22 and a respective one of the support legs 410. Each of the support legs 410 has the pivoted end portion 433 connected pivotally to the abutment member 310. Each linking member 510 has a length larger than a distance between the driving portion 521 and the pivoted end portion 433 of the corresponding support leg 410.

Figure 11:
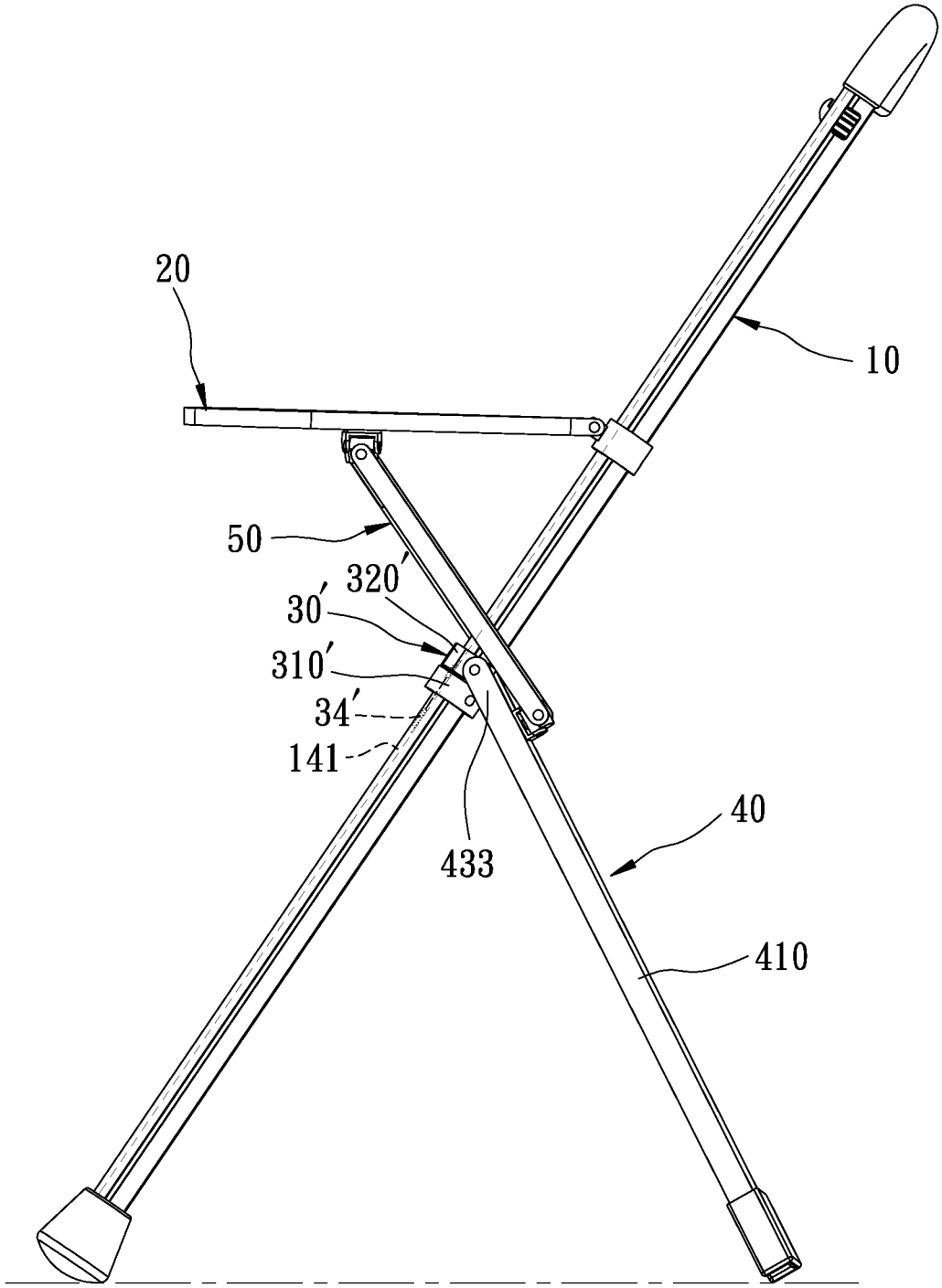
FIG. 11 is a side view of a sixth preferred embodiment according to the invention at the unfolded state.

As shown in FIG. 11, a sixth preferred embodiment of this invention is similar to the fifth preferred embodiment. The difference therebetween is that the positioning unit 30' includes the abutment member 310' and a middle slider member 320'. The pivoted end portion 433 of each of the support legs 410 is connected pivotally to the middle slider member 320'. The positioning unit 30' further includes a resilient member 34' disposed in the groove 141 and connected between the middle slider member 320' and the rod body 10 for biasing the middle slider member 320' toward the abutment member 310'.

Figure 12:
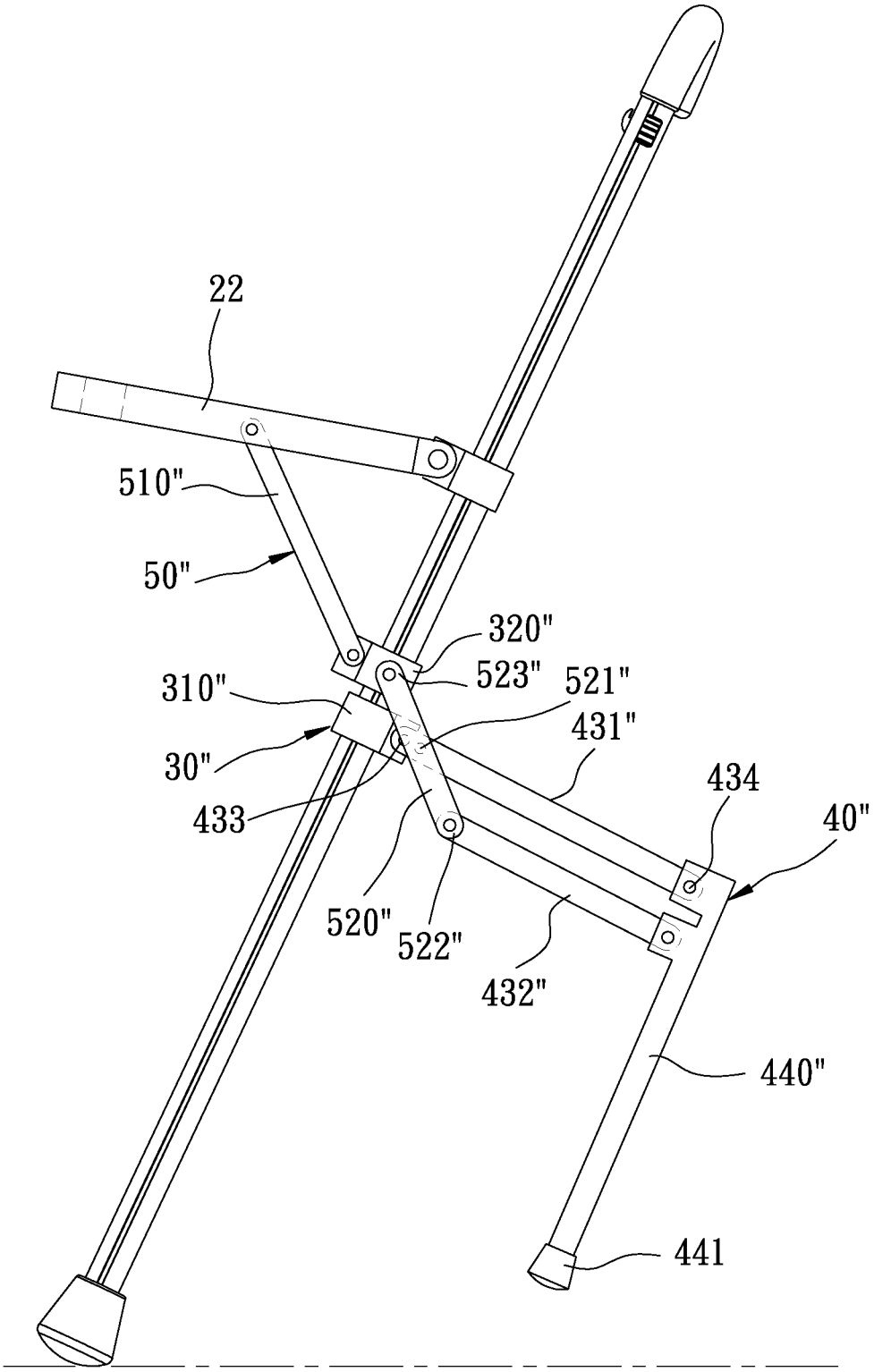
FIG. 12 is a side view of a seventh preferred embodiment according to the invention beginning to be folded.

FIG. 12 illustrates a seventh preferred embodiment of this invention, which is a variation of the first preferred embodiment. The positioning unit 30" includes the abutment member 310" and a middle slider member 320". The support unit 40" includes a pair of the upper leg components 431", a pair of the lower leg component 440", and a pair of sub-leg components 432". Each upper leg component 431" has the pivoted end portion 433 connected pivotally to the abutment member 310", and an opposite end portion 434 opposite to the pivoted end portion 433. Each lower leg component 440" has the free end portion 441, and an opposite end portion opposite to the free end portion 441 and connected pivotally to the opposite end portion 434 of a respective one of the upper leg components 431". Each of the sub-leg components 432" is disposed under and substantially parallel to a corresponding one of the upper leg components 431" and has one end connected pivotally to the opposite end portion of a respective one of the lower leg components 440". Each of the first linking members 510" of the linking unit 50" is connected pivotally between the seat member 22 and the middle slider member 320". Each of the second linking members 520" has a first end portion 523" connected pivotally to the middle slider member 320", a second end portion 522" opposite to the first end portion 523", and an intermediate portion 521" between the first and second end portions 523", 522". In this embodiment, the intermediate portion 521" and the second end portion 522" of each of the second linking members 520" serve as the driving portion, and are connected pivotally and respectively to the corresponding upper leg component 431" and the corresponding sub-leg component 432". Since the second linking members 520" are connected pivotally and respectively to the upper leg components 431", and each sub-leg component 432" interconnects pivotally the corresponding lower leg component 440" and the second end portion 522" of the corresponding second linking member 520", the linking unit 50" is capable of driving the lower leg components 440" to be folded or unfolded.

Figure 13:
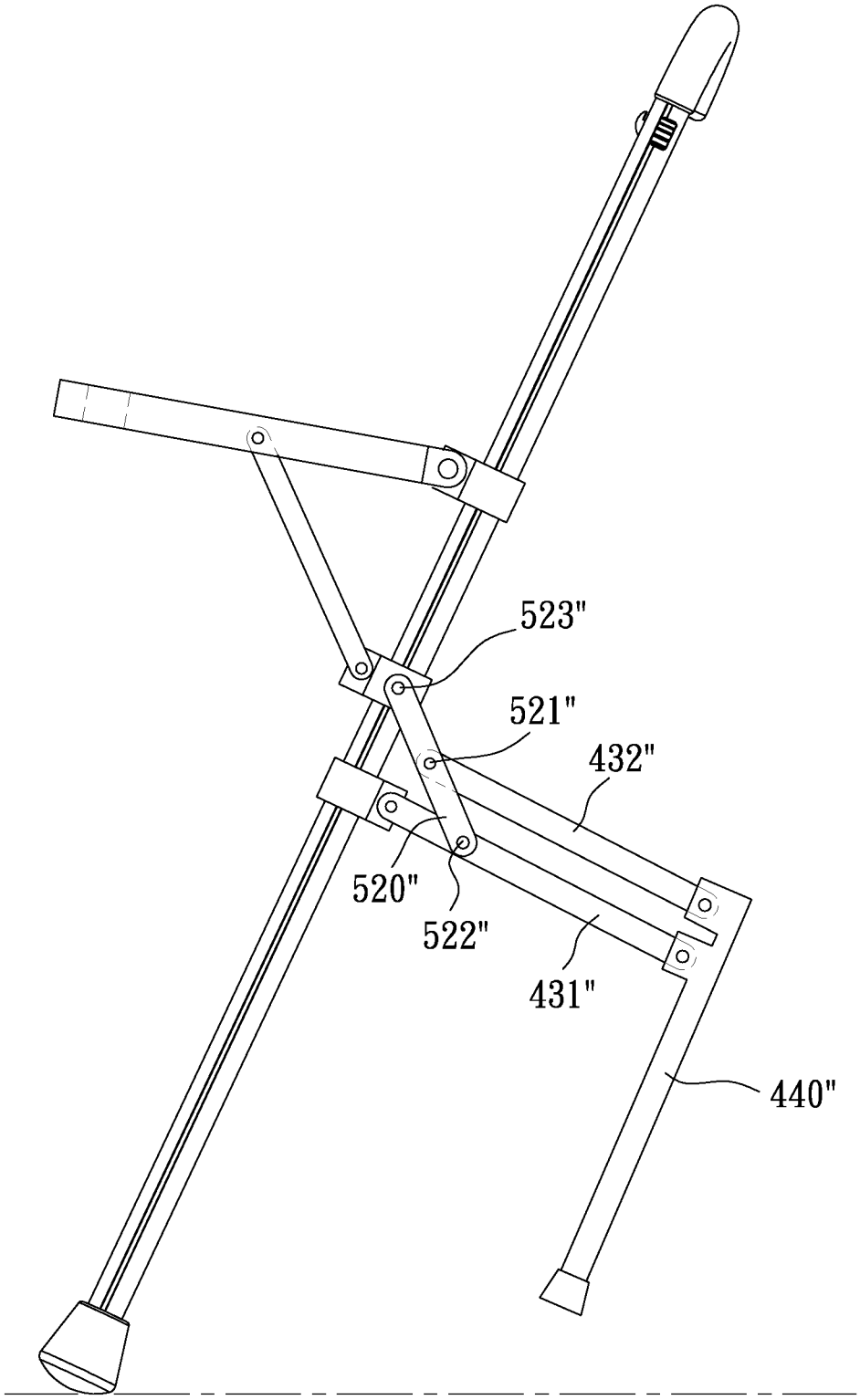
FIG. 13 is a side view of an eighth preferred embodiment according to the invention beginning to be folded.

FIG. 13 illustrates an eighth preferred embodiment of this invention, which is similar to the seventh preferred embodiment. What is different is that the intermediate portion 521" and the second end portion 522" of each of the second linking members 520", which serve as the driving portion, are connected pivotally and respectively to the corresponding sub-leg component 432" and the corresponding upper leg component 431". Each of the sub-leg components 432" is disposed above and substantially parallel to a corresponding one of the upper leg components 431". Since the second linking members 520" are connected pivotally and respectively to the upper leg components 431", and each sub-leg component 432" interconnects pivotally the corresponding lower leg component 440" and the intermediate portion 521" of the corresponding second linking member 520", the linking unit 50" is capable of driving the lower leg components 440" to be folded or unfolded.

Figure 14:
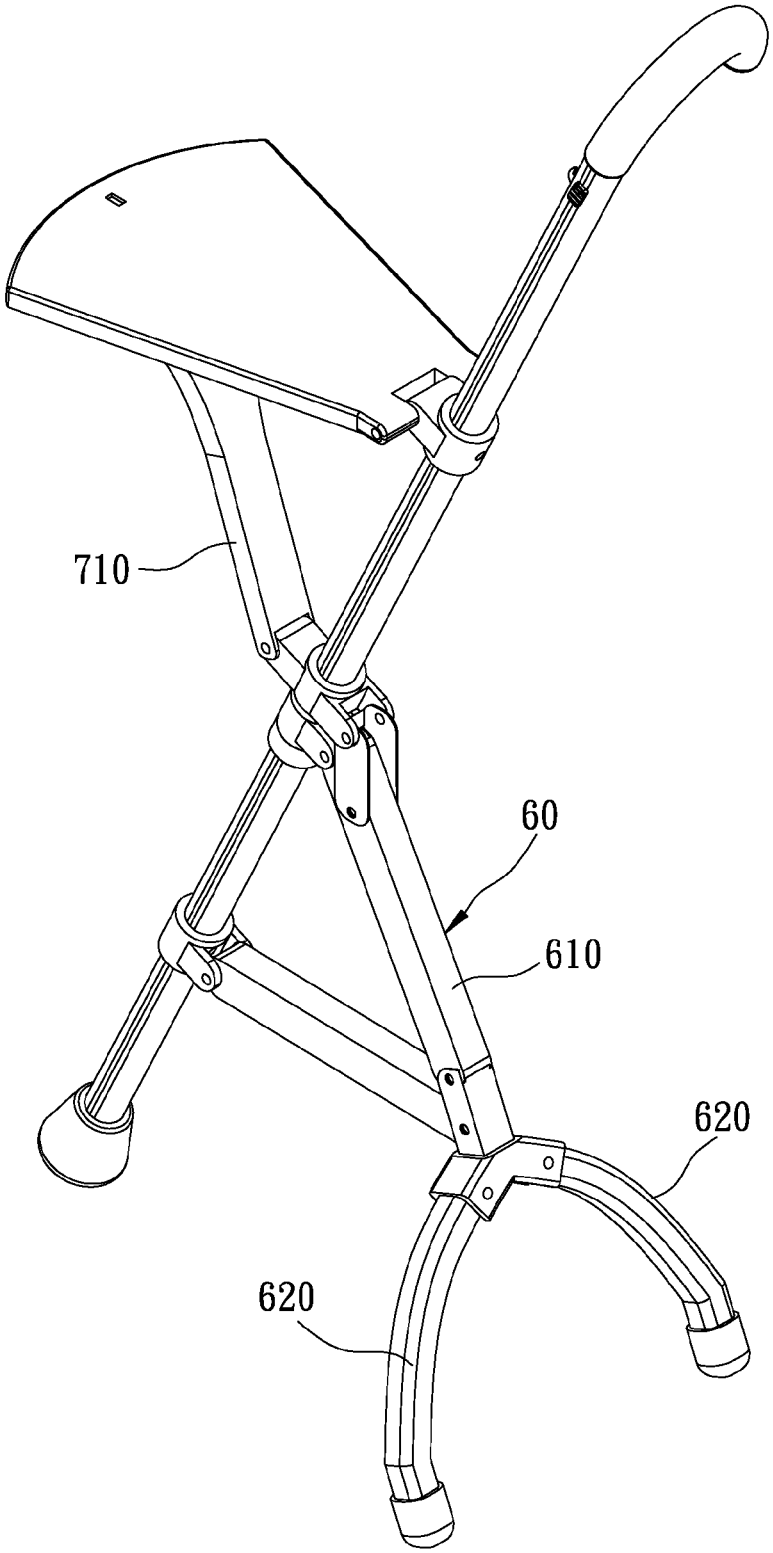
FIG. 14 is a perspective view of a ninth preferred embodiment according to the invention at the unfolded state.

Each of the embodiments in this invention so far has a pair of support legs. However, as shown in FIG. 14, the support unit 60 of a ninth preferred embodiment of this invention only has one upper leg component 610 and a furcated lower leg component 620 connected pivotally to the upper leg component 610. Moreover, the ninth preferred embodiment only includes one first linking member 710 without affecting the structural stability of the seat member 22.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A walking stick chair, comprising:

a main stick having an elongated rod body that has opposite upper and lower ends, a handle portion that is connected to said upper end of said rod body, and a foot portion that is connected to said lower end of said rod body;

a seat unit including a sleeve member that is connected in a fixed position to said rod body, and a seat member that is connected pivotally to said sleeve member and that is operable between a folded state where said seat member extends upwardly from said sleeve member and is close to said rod body, and an unfolded state where said seat member and said rod body form an angle;

a support unit having a pivoted end portion that is connected pivotally to said rod body under said sleeve member of said seat unit, and a free end portion that is opposite to said pivoted end portion; and a linking unit having a driven portion connected pivotally to said seat member and a driving portion connected pivotally to said support unit;

wherein, when said seat member is at the unfolded state, said support unit is at an unfolded state where said free end portion of said support unit is away from said rod body and cooperates with said foot portion for contacting ground;

wherein, when said seat member is operated to pivot upwardly from the unfolded state to the folded state, said linking unit is driven to move upwardly to actuate said support unit to pivot upwardly to a folded state where said free end portion is close to said rod body;

wherein said walking stick chair further comprises a positioning unit including an abutment member that is connected immovably to said rod body under said sleeve member, said pivoted end portion being positioned relative to said rod body by said abutment member; and wherein, said positioning unit further includes upper and lower slider members connected slidably to said rod body and disposed between said abutment member and said sleeve member, said upper slider member being disposed above said lower slider member, said pivoted end portion of said support unit being connected pivotally to said lower slider member, said linking unit including a first linking member that has said driven portion connected pivotally to said seat member and an opposite end connected pivotally to said upper slider member, and a second linking member that has said driving portion connected pivotally to said support unit and an opposite end connected pivotally to said upper slider member, and wherein, when said seat member moves to the unfolded state, said lower slider member moves toward said abutment member, and said upper slider member moves toward said lower slider member.

2. The walking stick chair as claimed in claim 1, wherein said rod body is formed with a groove extending in an outer surface of said rod body in a longitudinal direction of said rod body.

3. The walking stick chair as claimed in claim 1, wherein said positioning unit further includes a resilient member connected between said lower slider member and said rod body for biasing said lower slider member toward said abutment member.

4. The walking stick chair as claimed in claim 3, wherein said rod body is formed with a groove extending in an outer surface of said rod body in a longitudinal direction of said rod body, said resilient member being disposed in said groove.

5. The walking stick chair as claimed in claim 1, wherein said support unit includes at least one support leg that has an upper leg component and a lower leg component, said upper leg component having said pivoted end portion, said lower leg component having said free end portion and being connected pivotally to said upper leg component oppositely of said pivoted end portion.

6. The walking stick chair as claimed in claim 1, wherein said support unit includes at least one support leg that has an upper leg component and a lower leg component, said upper leg component having said pivoted end portion, said lower leg component having said free end portion and being connected pivotally to said upper leg component oppositely of said pivoted end portion, said main stick further having a bottom slider member connected slidably to said rod body and disposed between said lower slider member and said foot portion, and a connecting rod interconnecting co-movably said bottom slider member and said lower slider member, said support unit further including an auxiliary linkage that has opposite ends connected pivotally and respectively to said bottom slider member and said lower leg component.

7. The walking stick chair as claimed in claim 1, wherein a distance between said driven and driving portions of said linking unit is larger than that between said driving portion and said pivoted end portion of said support unit.

8. The walking stick chair as claimed in claim 1, wherein said second linking member of said linking unit has a length larger than a distance between said driving portion and said pivoted end portion of said support unit.

9. A walking stick chair comprising:

a main stick having an elongated rod body that has opposite upper and lower ends, a handle portion that is connected to said upper end of said rod body, and a foot portion that is connected to said lower end of said rod body;

a seat unit including a sleeve member that is connected in a fixed position to said rod body, and a seat member that is connected pivotally to said sleeve member and that is operable between a folded state where said seat member extends upwardly from said sleeve member and is close to said rod body, and an unfolded state where said seat member and said rod body form an angle;

a support unit having a pivoted end portion that is connected pivotally to said rod body under said sleeve member of said seat unit, and a free end portion that is opposite to said pivoted end portion; and a linking unit having a driven portion connected pivotally to said seat member and a driving portion connected pivotally to said support unit;

wherein, when said seat member is at the unfolded state, said support unit is at an unfolded state where said free end portion of said support unit is away from said rod body and cooperates with said foot portion for contacting ground;

wherein, when said seat member is operated to pivot upwardly from the unfolded state to the folded state, said linking unit is driven to move upwardly to actuate said support unit to pivot upwardly to a folded state where said free end portion is close to said rod body;

wherein said walking stick chair further comprises a positioning unit including an abutment member that is connected immovably to said rod body under said sleeve member, said pivoted end portion being positioned relative to said rod body by said abutment member;

wherein said support unit includes at least one support leg that has an upper leg component and a lower leg component, said upper leg component having said pivoted end portion, said lower leg component having said free end portion and being connected pivotally to said upper leg component oppositely of said pivoted end portion; and wherein said main stick further has a bottom slider member connected slidably to said rod body and disposed between said sleeve member and said foot portion, said support unit further including an auxiliary linkage having opposite ends connected pivotally and respectively to said bottom slider member and said lower leg component.

10. A walking stick chair comprising:

a main stick having an elongated rod body that has opposite upper and lower ends, a handle portion that is connected to said upper end of said rod body, and a foot portion that is connected to said lower end of said rod body;

a seat unit including a sleeve member that is connected in a fixed position to said rod body, and a seat member that is connected pivotally to said sleeve member and that is operable between a folded state where said seat member extends upwardly from said sleeve member and is close to said rod body, and an unfolded state where said seat member and said rod body form an angle;

a support unit having a pivoted end portion that is connected pivotally to said rod body under said sleeve member of said seat unit, and a free end portion that is opposite to said pivoted end portion; and a linking unit having a driven portion connected pivotally to said seat member and a driving portion connected pivotally to said support unit;

wherein, when said seat member is at the unfolded state, said support unit is at an unfolded state where said free end portion of said support unit is away from said rod body and cooperates with said foot portion for contacting ground;

wherein, when said seat member is operated to pivot upwardly from the unfolded state to the folded state, said linking unit is driven to move upwardly to actuate said support unit to pivot upwardly to a folded state where said free end portion is close to said rod body;

wherein said walking stick chair further comprises a positioning unit including an abutment member that is connected immovably to said rod body under said sleeve member, said pivoted end portion being positioned relative to said rod body by said abutment member; and wherein said main stick further has a bottom slider member connected slidably to said rod body and disposed between said sleeve member and said foot portion, said support unit including at least one support leg having said pivoted end portion and said free end portion, and an auxiliary linkage having opposite ends connected pivotally and respectively to said bottom slider member and said support leg.

11. The walking stick chair as claimed in claim 10, wherein said abutment member of said positioning unit is configured as a block protruding from an outer surface of said rod body, said bottom slider member having a passage groove adjacent to said outer surface of said rod body, said passage groove moving past said abutment member to permit said bottom slider member to slide over said abutment member when said seat member pivots from the unfolded state to the folded state.

* * * * *